United States Patent [19]

Flowers et al.

[11] 4,027,348

[45] June 7, 1977

[54] SKIN TREATMENT APPLIANCE

[75] Inventors: Theodore Robert Flowers, New Haven; Hermann Reinhold Schaefer, Bridgeport, both of Conn.

[73] Assignee: Sperry Rand Corporation, Bridgeport, Conn.

[22] Filed: Jan. 12, 1976

[21] Appl. No.: 648,508

[52] U.S. Cl. ..... 15/22 R; 51/170 MT; 74/50; 128/62 R

[51] Int. Cl.[2] ..... A46B 13/02

[58] Field of Search ..... 15/22 R, 22 C, 49 RB, 15/97 R; 128/62 R, 62 A, 45, 46, 48, 49; 51/170 MT; 132/85; 74/50

[56] References Cited

UNITED STATES PATENTS

| | | | |
|---|---|---|---|
| 807,299 | 12/1905 | Marshall | 15/22 R X |
| 3,570,035 | 3/1971 | Barnett | 15/22 R |
| 3,592,188 | 7/1971 | Barnett | 15/22 R X |

*Primary Examiner*—Edward L. Roberts
*Attorney, Agent, or Firm*—Charles R. Miranda

[57] ABSTRACT

A hand-held portable electrical skin treatment appliance and particularly for use in the care of facial skin wherein the appliance is provided with means for detachably mounting various skin treatment devices to a rotary drive output. The attachment device is provided with self-contained motion translating means for converting the rotary drive output orbital movement of the skin treatment device to enhance the massaging or cleansing effects to the skin of the user.

13 Claims, 8 Drawing Figures

SKIN TREATMENT APPLIANCE

BACKGROUND OF THE INVENTION

This invention is directed to new and useful improvements in portable electrical appliances and in particular to hand-held skin care and treatment appliances.

Hand-held treatment appliances adapted for cleaning, massaging or applying creams to the skin of the user have gained increasing popularity and are utilized to accomplish daily hygienic skin care and in particular for the care and cleanliness of the facial skin in an efficient manner. These devices usually include a small hand-held casing having a motor and a self-contained power source such as a battery for actuating the motor to effect operation of an output drive means within the casing. Skin treatment attachment devices such as, brushes, cleansing pads or massage devices are provided for selective attachment to the output drive means and upon operation of the motor are adapted to either reciprocate or rotate the skin treatment device to accomplish a desired skin care function in accordance with the singular motion imparted by the output means.

In certain of these known skin treatment appliances as for example that disclosed in U.S. Pat. No. 3,733,634, the output motion of a rotary drive means effects rotary movement of the skin treatment device. It has been found desirable that in addition to having a rotary output as that shown in the mentioned patent for applying a cleansing and massaging action that means also be provided for moving the attachment device in other paths such as an orbital path to provide an enhanced massaging action to the skin to thereby obtain better skin tone and stimulation of the skin tissue.

It is an object of the present invention to provide a novel hand-held skin treatment appliance.

It is another object of this invention to provide a novel skin care appliance having a skin treatment attachment device provided with self-contained novel motion translating means for driving an attachment output member in an orbital path.

A further object is to provide motion converting means within the casing of the attachment device apart from the main appliance casing.

A still further object is to provide a novel attachment device having self-contained motion converting means occupying a minimum area of operation and permitting a savings in cost both in assembly and manufacturing procedures.

SUMMARY OF THE INVENTION

The present invention contemplates a novel hand-held skin care and treatment appliance and in particular to improved attachment devices for the appliance having self-contained motion translating means for converting a rotary drive motion of the appliance to an orbital motion of the attachment output member. In one embodiment the attachment device comprises a brush output member mounted in a casing housing spaced rotatable cam elements positioned within spaced slot-chambers configurated to control directional movement of the brush upon rotation of the cam elements. Means are provided for interconnecting the cams to the rotary drive means of the appliance and upon operation of the rotary drive means the cams effect a motion to the brush.

The above and other objects and advantages of the present invention will appear more fully hereinafter from a consideration of the detailed description which follows taken together with the accompanying drawings wherein several embodiments of the invention are illustrated.

DETAILED DESCRIPTION

Figure 1:
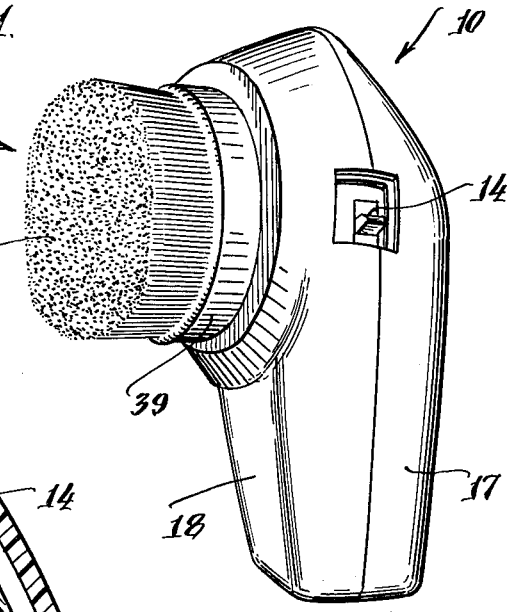
FIG. 1 is a perspective view of a skin treatment appliance and brush attachment device embodying the present invention.
Figure 2:
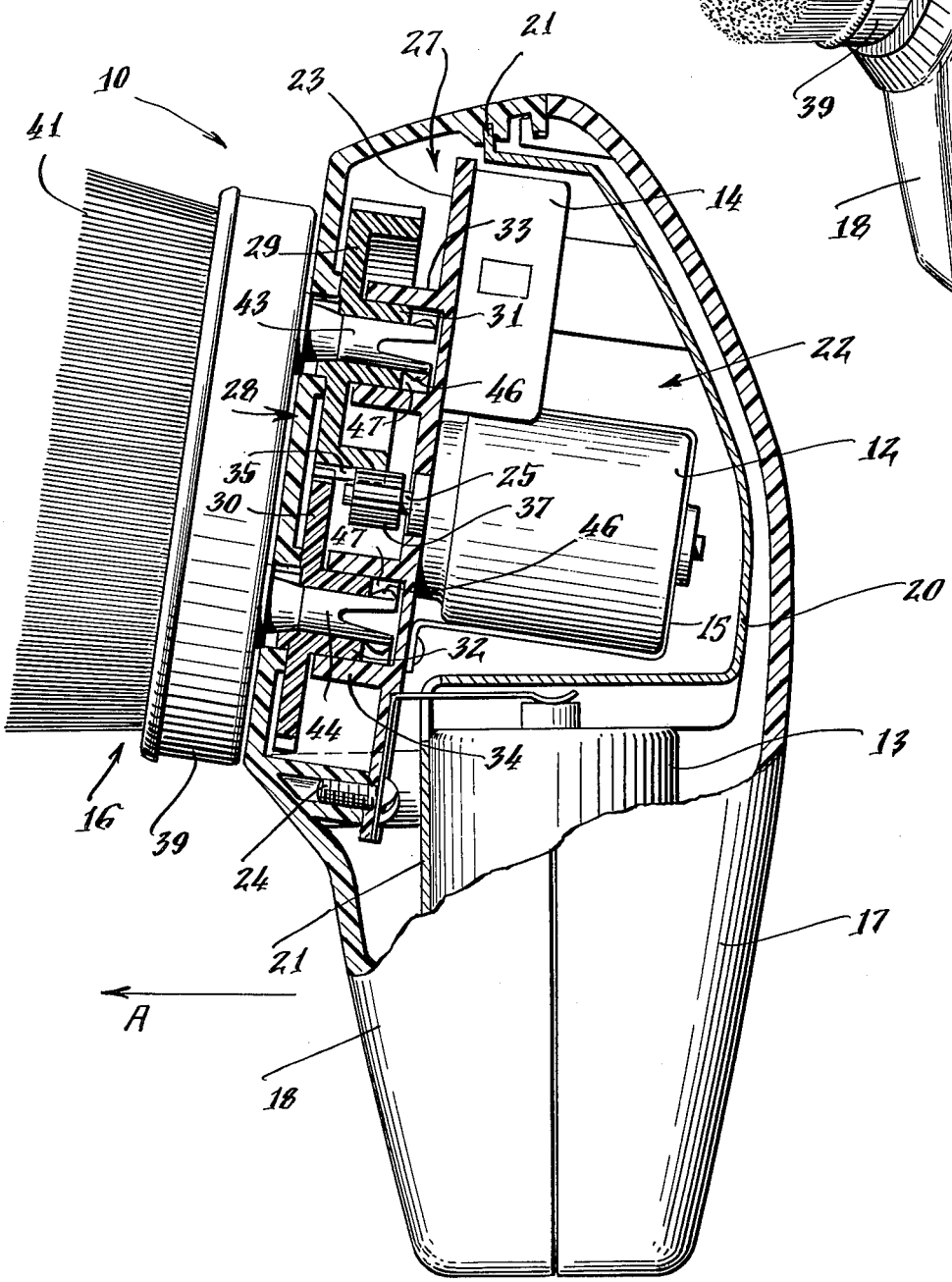
FIG. 2 is an enlarged elevational view of the appliance and attachment device of FIG. 1 with portions of the appliance casing broken away to show the internal operable elements thereof.

Referring now to the drawings for a more detailed description of the present invention and more particularly to FIGS. 1 and 2, a novel portable hand-held skin treatment appliance made according thereto is generally indicated by the reference numeral 10. Appliance 10 as shown includes a small low voltage DC motor and an internal source of power for motor 12 which includes a pair of batteries one of which is shown in FIG. 2 and designated by the numeral 13. Operation of motor 12 is controlled through on-off switch 14 in a usual manner to operate a brush assembly 16 in a manner to be hereinafter explanined in detail.

Appliance 10 comprises a casing of suitable hard premolded plastic material and includes upper and lower cup-shaped casing portions 17 and 18 respectively. Casing portions 17 and 18 are joined along peripheral edge portions in a suitable manner such as by means of detachable clips or screw members (not shown). A plastic shroud plate member 20 extends longitudinally within appliance 10 and is provided with a flanged ledge portion 21 for supporting thereon batteries 13 in side-by-side position. Batteries 13 may be of the disposable type and provide a source of power to motor 12 arranged at the opposite side of shroud 20 within a motor compartment 22 when switch 14 is utilized to establish an electrical connection in a usual manner.

Motor compartment 22 (FIG. 2) includes a support plate 23 secured to lower casing portion 18 by threaded fastening member 24. Motor 12 is mounted on one side of plate 23 by suitable means such as strap 15 and has a rotary drive shaft 25 extending into a drive gear compartment 27 having arranged therein gear drive means generally indicated by reference numeral 28.

Drive means 28 comprise spaced toothed drive gear 29 and driven gear 30 in mesh therewith. Each gear 29-30 has axially extending hub-portions 31-32 respectively disposed for rotation within circular bearing portions 33-34 formed on the bottom surface of plate 23. Drive gear 29 is provided with peripheral teeth 35 with the upper portion thereof meshed with pinion gear 37 secured to shaft 25 of motor 12. The lower portion of teeth 35 engage driven gear 30 whereupon operation of motor 12 pinion 37 is adapted to rotate gear 29 in one direction with teeth 35 of gear 29 enmeshed with gear 30 to rotate the latter gear 30 in an opposite direction.

Figure 4:
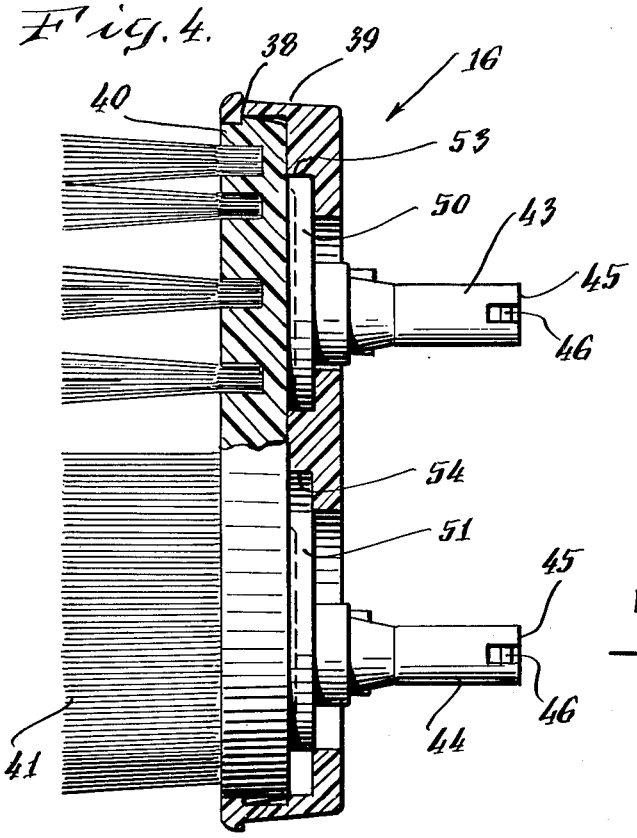
FIG. 4 is a sectional view taken along the line 4—4 of FIG. 3.
Figure 3:
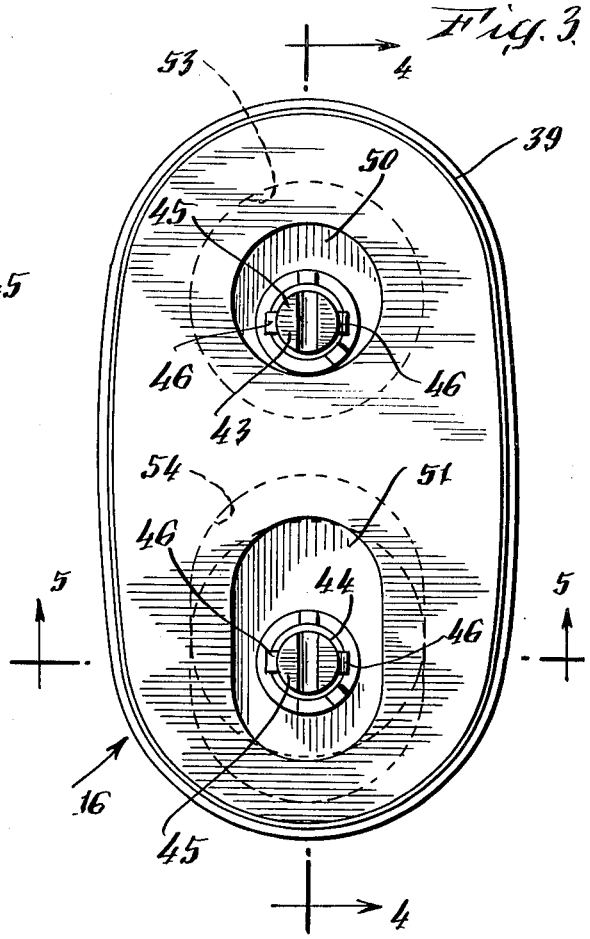
FIG. 3 is a plan view of the brush attachment device disconnected from the appliance casing.

Brush assembly 16 (FIG. 4) includes an oblong shaped premolded plastic casing comprised of upper cap portion 39 and lower brush supporting plate 40. Plate 40 is secured to the peripheral flange portion of cap 39 by any means such as snap fit connection 38. Brush filaments 41 are embedded in the surface of plate 40. Means are provided to attach brush assembly 16 to appliance 10 and include a pair of spaced post members 43 and 44 respectively inserted into the hollow axial hub portions 31-32 (FIG. 2) of gears 29 and 30.

The upper portions of posts 43-44 are provided with split flexible end portions 45 having spaced tabs 46. In attached position of assembly 16 to casing 10 (FIG. 2) tabs 46 are located in frictional engagement in spaced slots 47 formed in the upper edges of hubs 31-32 to maintain brush assembly 16 in secure position. If it is desired to detach brush assembly 16 from appliance 10 then manual pressure is exerted in the direction of arrow A (FIG. 2) to flex end portions 45 inwardly to free ears 46 from the slots 47 in hubs 31-33 whereby brush 16, can be readily withdrawn from appliance 10. Brush assembly 16 is readily attached to appliance 10 by following the reverse procedure and inserting posts 43-44 into hubs 31-33 to flex ends 45 until tabs 46 are located in slots 47.

As mentioned it is a feature of the present invention to provide a novel motion translating means for converting the rotary motion of drive means 28 to drive brush assembly 16 in an orbital path. To this end spaced cams 50 and 51 (FIG. 4) are provided at the base of posts 43-44 respectively, and which cams 50-51 and posts 43-44 are formed of premolded plastic material. Means for controlling movement of brush assembly casing 16 through cams 50-51 includes post 43 positioned eccentrically on cam 50 which is entrapped within a circular slot-chamber 53 formed by cap 39 and brush support plate 40. Post 44 is positioned eccentrically on cam 51 and is located in an elongated slot-chamber 54 which is also formed by cap 39 and plate 40.

Figure 6:
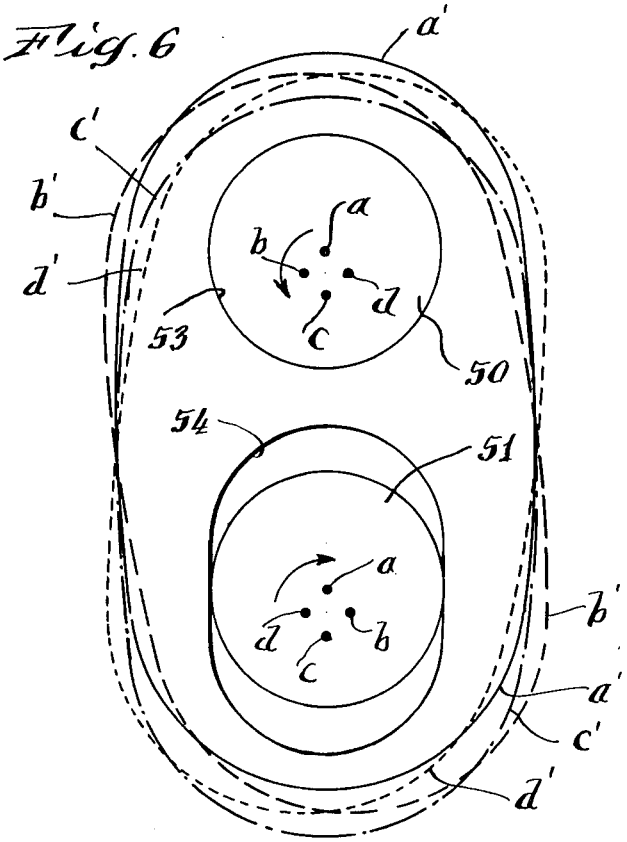
FIG. 6 is a schematic plan view of the orbital path of movement of the attachment device of FIGS. 1 to 5 showing the various positions of movement thereof during one revolution of the appliance drive means.
Figure 5:
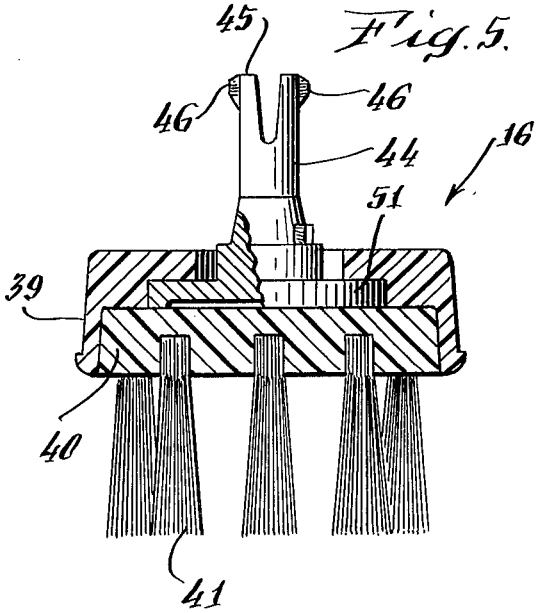
FIG. 5 is a sectional view taken along the line 5—5 of FIG. 3.

In operation of appliance 10 with brush assembly casing 16 attached to drive means 28 (FIG. 2) the rotary motion of gears 29 and 30 through pinion gear 37 effects rotation of posts 43 and 44. Cam 50 constrained within circular slot 53 causes the upper end of casing 16 (FIG. 6) to tend to rotate relative to casing 10. Opposite cam 51 within elongated slot 54 and rotating in an opposite direction to cam 50 is carried by the walls of chamber 54 to reciprocate the adjacent lower end of casing 16 (FIG. 6) in a reciprocatory path transverse to the longitudinal axis of casing 16. The motion of cams 50-51 in operation of appliance 10 is schematically illustrated in FIG. 6 through one revolution of the drive means 28. The positions of rotation of shaft posts 43-44 of casing 16 are indicated by the position designations a'; b'; c'; and d'; and corresponding designations a; b; c; and d; are applied to the broken line illustrated positions of movement of casing 16 relative thereto. It will be noted from the schematic representation that the upper end of brush assembly (as viewed in FIG. 6) tends to swing in an arcuate path through positions *a; b; c;* and *d;* with the lower end portion moved in lateral transverse reciprocal path. As a result of this controlled movement brush assembly 16 is driven in an orbital path closely resembling a "FIG. 8" type pattern.

Figure 7:
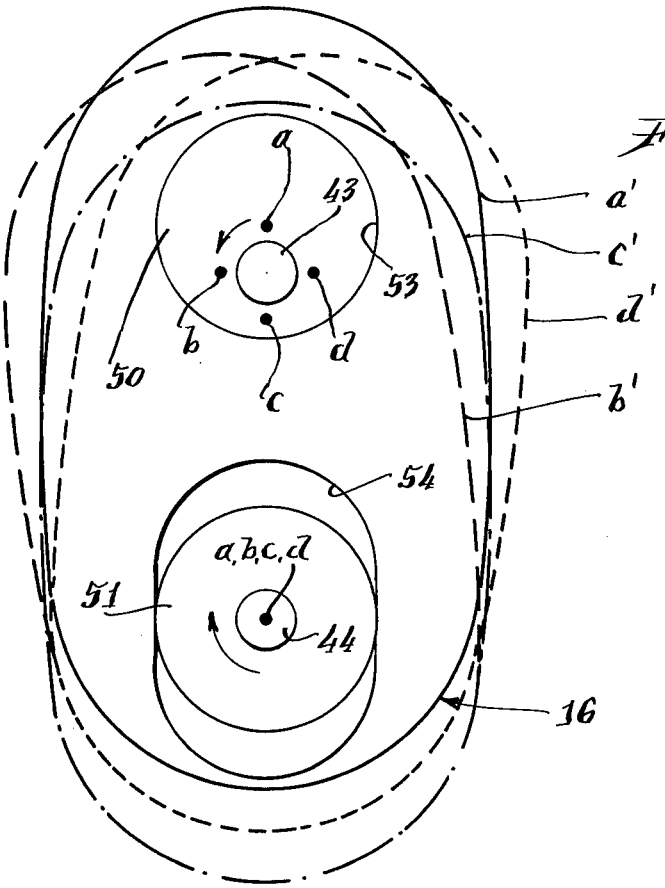
FIGS. 7 and 8 are schematic plan views of various other orbital path embodiments of the present invention.
Figure 8:
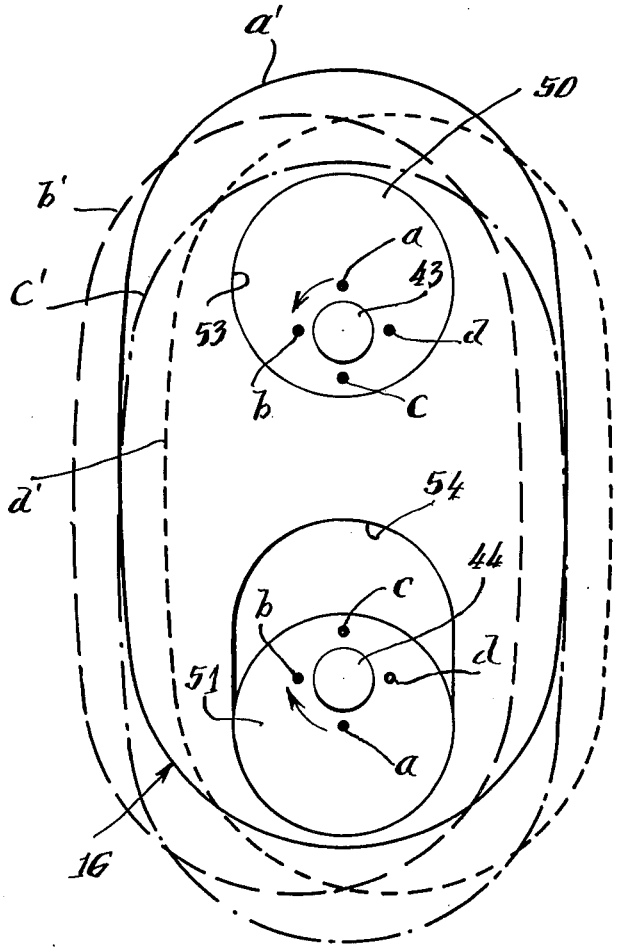

In FIGS. 7 and 8 are illustrated other embodiments of the present invention and which FIGS. 7 and 8 are schematically illustrated other cam and post arrangements for effecting orbital movement of the attachment device 16. In these embodiments the same structure as the embodiments of FIGS. 1 to 6 is utilized except that the position of posts 43-44 is varied with respect to their associated cams 50-51 and/or drive means 28. Like reference numerals and letter designations relative to the positions of posts 43-44 and casing 16 through one revolution of the drive means 28 are therefore utilized.

In FIG. 7, as in the embodiment of FIGS. 1 to 6, post 43 is arranged eccentrically on cam 50, however, post 44 is postioned concentrically on cam 51. As a result in operation as posts 43-44 rotate through positions *a*, *b*, *c*, and *d*, the upper end (FIG. 7) of casing 16 swings in arcuate path while the lower end follows in a reciprocatory path as indicated by the designations *a'*, *b'*, *c'* and *d'*.

In FIG. 8 both posts 43-44 are aranged eccentrically as in FIGS. 1 to 6, however, posts 43-44 are positioned 180° out of phase to each other achieving the orbital path of motion designated by the position *a'*, *b'*, *c'* and *d'* upon operation of drive means 28.

It is apparent from the foregoing that the novel skin treatment appliance and attachment has many advantages in use. One advantage is that the novel motion translating means are contained within the attachment casing thereby allowing if desired attachment of other type skin treatment devices to appliance 10 for movement in other selected different paths such as rotary or reciprocating as might be desired without alteration of the gear means 28.

Although several embodiments of the present invention have been illustrated and described in detail, it is to be expressly understood that the invention is not limited thereto. Various changes can be made in the design and arrangement of parts and the elective positioning and configuration of cams 50-51 and posts 43-44 without departing from the spirit and scope of the invention as the same will now be understood by those skilled in the art.

What is claimed is:

1. A skin treatment attachment for a portable electrical skin treatment appliance having a motor and rotary drive means for operating the attachment, the attachment comprising;

a. a casing containing skin treatment output means,
b. means detachably connecting said casing to the appliance,
c. rotable cam means within the casing,
d. means for connecting said cam means to the appliance drive means,
e. means for directing movement of the casing upon operation of the rotary drive means, and
f. means within the casing for converting motion of the rotatable cam means to orbital motion of the skin treatment output means.

2. The attachment of claim 1 wherein said cam means include a pair of spaced cam members arranged within a pair of chambers formed in the casing wherein said movement directing means include walls of said chambers engaging with the cam members.

3. The attachment of claim 2 wherein said cam members are of circular configuration with at least one of the cam members being eccentrically rotatable relative to the rotary drive means.

4. The attachment of claim 3 wherein both of the cam members are eccentrically rotatable with respect to the rotary drive means.

5. The attachment of claim 4 wherein one of the cam members is arranged in one of said chambers, said one chamber having a circular shape and the other cam member is arranged in the other chamber said other chamber having an elongate shape.

6. A skin treatment appliance comprising;

a. a first hand-held casing housing a motor and rotary drive means including a drive gear and a driven gear operable by said motor, b. a second casing including rotatable cam means and skin treatment output means, c. means for detachably connecting said second casing to said first casing and said cam means directly to both of said gears for operation thereby, and d. means within the second casing for converting motion of the gear driven cam means to orbital motion of the skin treatment output means.

7. The appliance of claim 6 wherein the driven gear rotates counterclockwise to the drive gear upon operation of said motor.

8. The appliance of claim 6 wherein said cam means include a first rotatable cam eccentrically connected to said drive gear and constrained for rotation in a circular path and a second rotatable cam spaced from said first cam connected to said driven gear.

9. The appliance of claim 8 wherein said means for detachably connecting the first and second casings include rotatable post members connected to the first and second cam members, and said post member provided with means for detachable connection to the drive gear and the driven gear.

10. The appliance of claim 9 wherein the cams are of circular configuration and wherein spaced chambers are formed in the second casing for locating the cams and controlling orbital movement of the second casing upon operation of the rotary drive means.

11. The appliance of claim 9 wherein a first of said post members is eccentrically attached to the first cam located within one of said chambers having a circular shape, and wherein a second of said post members is eccentrically attached to the second cam located within another of said chambers having an elongate shape, said cams in driving engagement with the walls of the chambers to drive the second casing in an orbital path upon operation of the drive and driven gears.

12. The appliance of claim 6 wherein the cam means comprise a pair of eccentrically arranged cams.

13. The appliance of claim 6 wherein the cam means comprise a pair of eccentric cams arranged 180° out of phase.

* * * * *